US005900295A

United States Patent [19]

Kawada

[11] Patent Number: 5,900,295

[45] Date of Patent: May 4, 1999

[54] FIXING ROLLER FOR ELECTROPHOTOGRAPHIC DEVICE AND METHOD FOR FABRICATING THE SAME

[75] Inventor: Noriaki Kawada, Kawasaki, Japan

[73] Assignee: Fuji Electric Co., Ltd., Kanagawa, Japan

[21] Appl. No.: 08/821,291

[22] Filed: Mar. 20, 1997

[30] Foreign Application Priority Data

Mar. 25, 1996 [JP] Japan ..... 8-067544

[51] Int. Cl.[6] ..... G03G 15/20

[52] U.S. Cl. ..... 428/36.9; 428/36.91; 428/35.8; 428/457; 492/53; 492/56; 399/333

[58] Field of Search ..... 428/36.9, 36.91, 428/35.8, 457; 492/53, 56; 399/333

[56] References Cited

U.S. PATENT DOCUMENTS 5,724,637 3/1998 Senba et al. ..... 399/333

FOREIGN PATENT DOCUMENTS 58-65619 4/1983 Japan .

3-80279 4/1991 Japan .

8-262910 10/1996 Japan .

*Primary Examiner*—Mark Chapman

*Attorney, Agent, or Firm*—Venable; Robert J. Frank; Michael A. Sartori

[57] ABSTRACT

A fixing roller for an electrophotographic device has a cylindrical-shaped metallic base body, an insulation layer formed on an outer peripheral surface of the cylindrical-shaped metallic base body, and a resistance resin layer laminated on the insulation layer. The resistance resin layer is prepared using an injection-molding technique in which a die having a side gate structure is used as a resin-molding die. A major constituent of the resistance resin layer is selected from a polyphenylene sulfide resin, a polyphthalamide resin, and a liquid crystal polymer resin. In addition, the resistance resin layer also contains a mixture of carbon black and carbon fiber. Thus, the resistance resin layer has a specific volume resistance of 2 Ωcm or less in a direction along a central line of the cylindrical-shaped metallic base body. Both ends of the resistance resin layer are concentrically connected to ring-shaped metallic electrodes. Furthermore, the insulating layer is comprised of the same resin as that of the resistance resin layer.

22 Claims, 1 Drawing Sheet

FIXING ROLLER FOR ELECTROPHOTOGRAPHIC DEVICE AND METHOD FOR FABRICATING THE SAME

BACKGROUND OF THE INVENTION

1. Field of the Invention

The present invention relates to a fixing roller used for fixing toner on a sheet of paper and installed on an electrophotographic device such as a copying machine, a printer, or a facsimile machine, and also the present relates to a method for fabricating the fixing roller.

2. Description of the Prior Art

A fixing roller is a structural element of an electrophotographic device and is used to fix an image on a sheet of paper or the like. In the electrophotographic device, the fixing roller is positioned in front of a pressing roller in parallel and heated at a predetermined temperature. When a sheet of paper on which toner is being attached is passed through these rollers, the toner is heated and fused on the paper.

The conventional fixing roller uses indirect heating and has an electric heater positioned at the inside of a cylindrical-shaped aluminum tube. Thus the heater heats the cylindrical-shaped aluminum tube to indirectly heat and soften the toner on the paper. Furthermore, the cylindrical-shaped aluminum tube may be coated with 4-fluorinated ethylene to prevent an unintentional or faulty transfer of the softened toner to a surface of the fixing roller (i.e., a toner offset phenomenon), which leads to degradation in image quality of the printed sheet.

The conventional fixing roller uses direct heating, has been recently developed, and comprises a machined metal core on which an insulating layer, a heating resistance element, and a coating of 4-fluorinated ethylene are applied in that order (Japanese Patent Application laying-open No. 3-80279(1991)). This fixing roller is characterized by a direct conduction of heat from the heating resistance element to the toner.

However, the above conventional rollers have the following disadvantages. In the case of the indirect-heating type, the electric heater is separated from the cylindrical-shaped aluminum tube. Thus, the electrophotographic device cannot be used efficiently because too much time is taken to heat the cylindrical-shaped aluminum tube to a predetermined temperature after electric current is initially passed through the electric heater. To improve the efficiency of the electrophotographic device, the above tube can be heated all the time, but this leads to a large power consumption Another disadvantage is the high cost of manufacturing the electric heater separately from the machining and coating of the cylindrical-shaped tube.

In the case of the direct-heating type, the fixing roller can be heated up in a short time. However, as the fixing roller is prepared by applying or coating three different layers on a surface of the metallic core, the laminated layers on the tube must be kept in absolute contact with one another, and the laminate must not thermally expand when electric current is passed through the electric heater for heating the cylindrical-shaped aluminum tube.

SUMMARY OF THE INVENTION

It is an object of the present invention to provide a fixing roller for an electropthographic device and its manufacturing method, in which the fixing roller has the properties of heating up in a short time and lowering power consumption without causing toner offset.

In a first aspect of the present invention, there is provided a fixing roller for an electrophotographic device, comprising:

a cylindrical-shaped metallic base body;

an insulation layer formed on an outer peripheral surface of the cylindrical-shaped metallic base body; and a resistance resin layer laminated on the insulation layer.

Here, the specific volume resistance of the resistance resin layer in a direction along a central line of the cylindrical-shaped metallic base body may be 2 Ωcm or less.

The major constituent of the resistance resin layer may be a resin selected from a group consisting of a polyphenylene sulfide resin, a polyphthalamide resin, and a liquid crystal polymer resin.

The resistance resin layer may comprise:

a resin selected from a group consisting of a polyphenylene sulfide resin, a polyphthalamide resin, and a liquid crystal polymer resin; and a mixture of carbon black and carbon fiber, where 10 to 50% by weight of the mixture is included in the resistance resin layer and a weight ratio expressed as a weight of the carbon black divided by a weight of the carbon fiber is in a range of 0.25 to 4.5.

The insulating layer may be made of a resin which is same as the resin comprised in the resistance resin layer.

The cylindrical metallic base body may be selected from a group consisting of an aluminum and an aluminum alloy.

The insulating layer may be an anodic oxidize layer.

The ring-shaped metallic electrodes may be concentrically formed on both ends of the resistance resin layer, respectively.

The resistance resin layer may be prepared using an injection-molding technique.

The resistance resin layer may be prepared using an injection-molding technique in which a die having a side gate structure is used as a resin-molding die.

The fluororesin-based coating may be further applied on the outer peripheral surface of the cylindrical-shaped metallic base body after forming the resistance resin layer.

In a second aspect of the present invention, there is provided a method of forming a fixing roller for an electrophotographic device, comprising steps of:

forming an insulating layer on an outer peripheral surface of a cylindrical metallic base body; and forming a resistance resin layer on the insulating layer.

Here, the specific volume resistance of the resistance resin layer in a direction along a central line of the cylindrical-shaped metallic base body may be 2 Ωcm or less.

The major constituent of the resistance resin layer may be a resin selected from a group consisting of a polyphenylene sulfide resin, a polyphthalamide resin, and a liquid crystal polymer resin.

The above and other objects, effects, features, and advantages of the present invention will become more apparent from the following description of embodiments thereof taken in conjunction with accompanying drawings.

DETAILED DESCRIPTION OF PREFERRED EMBODIMENTS

Figure 1:
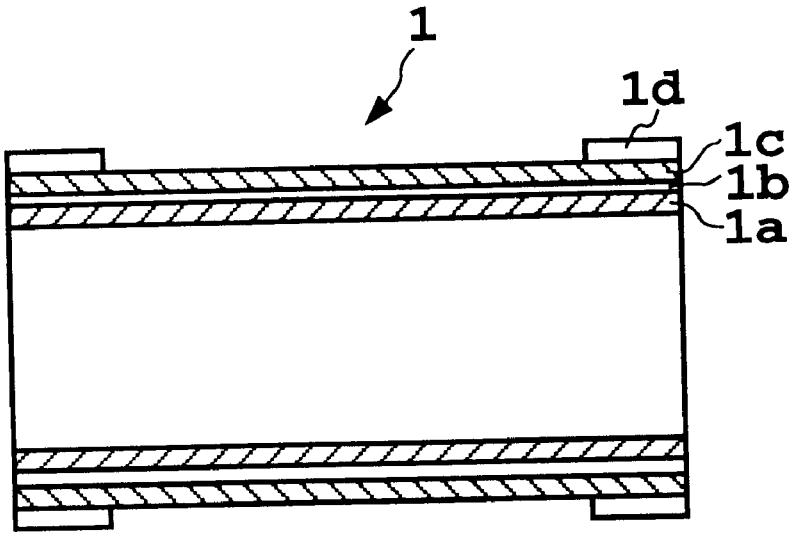
FIG. 1 is a cross sectional view of a fixing roller in accordance with the present invention.

FIG. 1 illustrates an embodiment of the present invention, wherein a fixing roller 1 to be installed in an electrophotographic device comprises: a cylindrical-shaped metallic base body 1*a;* an electrical insulating layer 1*b* laminated on an outer peripheral surface of the base body 1*a;* and a resistance resin layer 1*c* which is injection-molded on the electrical insulating layer 1*b*. In addition, ring-shaped electrodes id are concentrically fixed on both end portions of the resistance resin layer 1*c*. These ring-shaped electrodes are responsible for applying power to the resistance resin layer 1*c* to induce Joule heat.

The cylindrical-shaped metallic base body 1*a* is preferably made of an aluminum or an aluminum alloy because of the properties being of lightweight, easy to process, and having a small heat capacity. However, the base body is not limited to such material, and other materials can be used. To prevent heat from being released from the resistance resin layer, the thickness of the base body should be as small as its mechanical strength allows. For example, the thickness of the base body can be 2 mm or less if it is made of aluminum.

To apply power only to the resistance resin layer 1*c,* the interface between the metallic base body 1*a* and the resistance resin layer 1*c* should be insulated. If the metallic base body 1*a* is made of an aluminum based material, an anodic oxide layer may be formed as the insulating layer 1*b* on the surface of the base body by anodic oxidation. The insulating layer is not limited to this material, and other materials can be used. For example, if a resin, which has insulation properties, is provided as a principal component of the resistance resin layer 1*c* such a resin can be used instead of the anodic oxide layer for the insulating layer. In this case, there is no problem of adherence between the insulating layer and the resistance resin layer because the same resin is used for both the insulating layer and the resistance resin layer.

The resin that constitutes the resistance resin layer 1*c* directly contacting to toner should be of the type having the properties of great mechanical strength and heat resistance in addition to a small stickiness to the toner. Furthermore, the resin should be able to be used in injection molding for attaining the high dimensional accuracy of the fixing roller 1. The resin that satisfies these requirements may be one selected from a polyphenylene sulfide (PPS) resin, a polyphthalamide (PPA) resin, and a liquid crystal polymer (LCP) resin.

For the conductive material to be used in the resistance resin layer 1*c,* a carbon black material and a carbon fiber material can be used because of their high conductivity and heat-resisting ability in addition to their ability to readily form a uniform mixture with the above resin. If the resin is mixed with the carbon fiber material, the conductivity of the resin in the direction of the length of the fiber material is high, and the mechanical strength of the resin is improved due to the tangled carbon fibers. In this case, however, the conductivity of the resin in the direction of the width of the fiber material is extremely low. During the process of injection molding, the carbon fibers are oriented along the direction of the length of the fixing roller, so that the carbon black powders are filled into the space between the fibers as a result of the above mixing to improve the conductivity in the direction of the circumference or thickness of the fixing roller. A specific volume resistance of the mixed material can be estimated by measuring the resistance between both ends of the above prepared resistance resin layer and using parameters of mean diameter, thickness, and length.

To improve the homogeneity of the dispersant obtained by mixing the carbon black material with the resin, calcium carbonate or firing clay can be added as an additive.

A fixing temperature for the toner is in the range of 130 to 180 C.° In general, the time required to heat up the toner to the fixing temperature is 20 seconds or less. If the electrical resistance between two ends of the fixing roller is less than about 20 Ωcm, the resistance resin layer of the present invention can be heated to the above fixing temperature within 20 seconds or less by passing a current through both cylindrical-shaped ends. In the present example, the resistance resin layer has a diameter of 30 mm and a length of the order of 260 to 300 mm, so that a wall thickness of the fixing roller may be less than 2 mm to maintain the above properties at adequate levels. A specific insulation resistance for the shape of the fixing roller for minimizing the electrical resistance (i.e., an upper limit to the specific insulation resistance of the fixing roller) is about 2 Ωcm.

The weight ratio between the carbon black material and the carbon fiber material expressed as the weight of the former divided by that of the latter is in the range of 0.25 to 4.5.

In the direct-heating process, an electric power supplying portion to performs a sliding movement because the resistance resin layer is rotated. Because the resistance resin layer has different electric resistance according to the direction of measurement, the electrodes are fixed on the cylindrical-shaped sides of the resistance resin layer to produce a uniform current.

Figure 2:
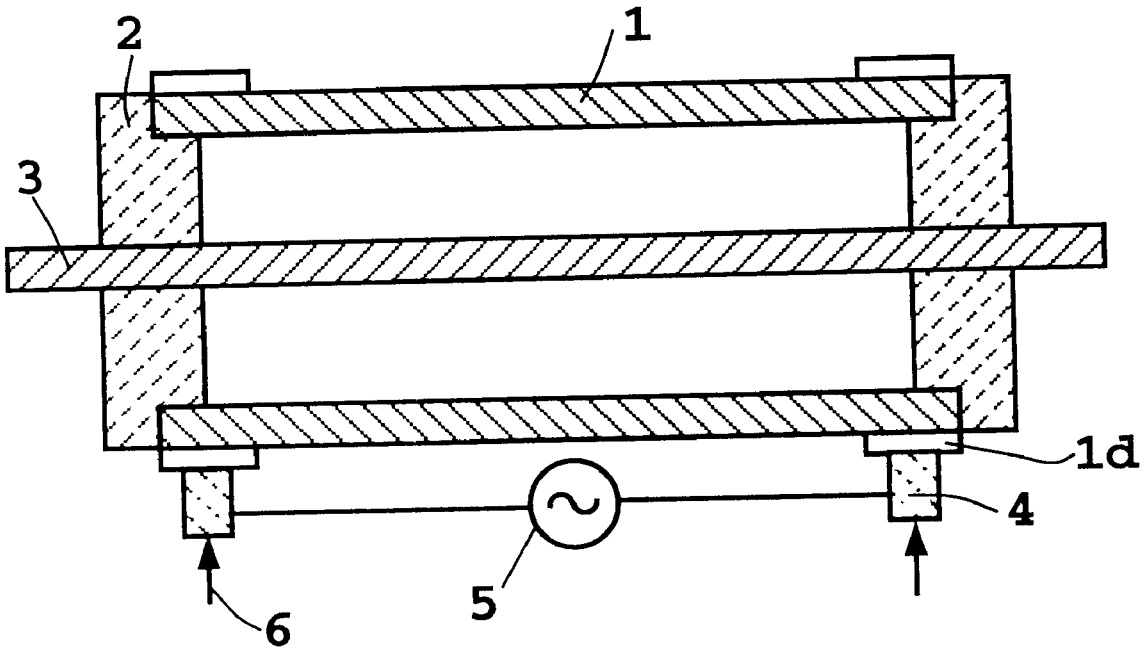
FIG. 2 is a cross sectional view of the fixing roller of the present invention, in which metallic electrodes are connected to terminals of a power supply via carbon brushes.

The conductive electrode id may be a metallic ring or metallized ring, which is fixed on the resistance resin layer by an electrical conductive adhesive material. The conductive electrode 1*d* can be powered through contact with a spring-loaded carbon brush 4 connected to a power supply 5. In FIG. 2, the carbon brush 4 is moved upward so as to connect to a peripheral surface of the electrode.

It is preferable to use a pair of flanges 2 made of a conductive material for holding the fixing roller in place. The flanges 2 are concentrically fixed on a shaft member 3 and placed on the ends of the fixing roller.

EXAMPLE 1

Five types (A–E) of fixing rollers were prepared using different resin layers 1*c* formed on a cylindrical-shaped metallic base body 1*a*. Each of these different resin layers 1*c* was prepared from a PPS resin (PPS M3910 manufactured by Toray Co., Ltd.) as a base component and a mixture of conductive materials consisting of a carbon fiber material (Toreca T-006 manufactured by Toray Co., Ltd.) and a carbon black material (BP480 manufactured by CAPOT Co., Ltd.) at a predetermined ratio depending on the type as shown in Table 1. In addition, a predetermined amount of an inorganic additive, i.e., calcium carbonate (NS-200 manufactured by Nitto funka Co., Ltd.,) was further included in the resistance resin layer. Each type of fixing roller was prepared as follows.

First, the metallic base body 1*a* was prepared as a cylindrical-shaped aluminum tube (260 cm in length, 28 mm in outer diameter, 26 mm in inner diameter, and 1 mm in thickness) on which an electrical insulating layer 1*b* was formed as an anodic oxide layer of 5 to 10 μm in thickness. An injection die was used in the present example and had a core diameter of 26 mm and a cavity diameter of 30 mm, with five ring gates. The cylindrical-shaped aluminum tube 1*a* was placed on the core of the injection die and then mounted on an injection molding machine to form a resistance resin layer 1*c* on a peripheral surface of the tube 1*a*. The molding was performed with a resin temperature of 350

C.°, and a die temperature of 150 C.°, an injection pressure of 245 Mpa, which resulted in the molded resistance resin layer 1*c* of 2.0 mm in thickness. If the number of the ring gates was 2 or less in the above injection die, a resistance of the resistance resin layer 1*c* could be lowered enough to satisfy the condition described above.

The obtained fixing roller showed its specific volume resistance as listed in Table 1.

TABLE 1

| | Types of fixing rollers | | | | |
|---|---|---|---|---|---|
| | A | B | C | D | E |
| PPS resin | 60 | 55 | 50 | 50 | 55 |
| Carbon black (B) | 5 | 10 | 10 | 20 | 18 |
| Carbon fiber (F) | 20 | 30 | 5 | 5 | 4 |
| Inorganic additive | 15 | 5 | 35 | 25 | 23 |
| Mixing ratio (B/F) | 0.25 | 0.33 | 2 | 4 | 4.5 |
| Specific volume resistance (Ωcm) | 4.5 | 0.45 | 0.65 | 0.87 | 8.7 |

Furthermore, the fixing rollers in the respective types were subjected to temperature-rise tests as follows.

Each of the fixing rollers was fixed on a pair of flanges 2 made of an electrically insulated resin and then a shaft 3 was inserted through the flanges 2 as shown in FIG. 2. In this example, ring-shaped metallic electrodes (1 mm in thickness and 10 mm in width) were fixed on both ends of the resin layer 1*b*. The electrodes 1*d* were powered by contacting a spring-loaded carbon brush 4 connected to a power supply 5.

A total length resistance and a heat-up time from a room temperature to 160 C.° of the fixing roller was measured, and also an offset of toner particles (i.e., an unintentional or faulty transfer of toner particles to a surface of the fixing roller under heat) was observed. The results are listed in Table 2.

TABLE 2

| | Types of fixing rollers | | | | |
|---|---|---|---|---|---|
| | A | B | C | D | E |
| Total length resistance (Ω) | 100 | 10 | 15 | 20 | 2000 |
| Heat up time (sec) | 90 | 10 | 15 | 20 | *1 |
| Toner offset | good | good | good | good | — |

As shown in Table 2, the fixing rollers of the type of tyes B, C, or D (i.e., the samples B, C, or D) have a heat-up time of 20 seconds or less because the weight ratio between the carbon black and the carbon fiber is in the range of 0.33 to 4.0. The fixing roller of type A (i.e., the sample A) requires a longer heat-up time compared with that of the samples B, C, and D, and it takes 90 seconds to heat up to 160 C.°. The fixing roller of type E (i.e., the sample E) cannot be heated up to over 50 C.° in spite of heating for a long period. Furthermore, samples A, B, C, D, and E show excellent offset properties because no toner was found on the surface of any of the fixing rollers. It is noted that the offset properties were not affected by applying a fluororesin on the outer surface of the fixing roller.

EXAMPLE 2

A fixing roller was prepared using the same cylindrical-shaped aluminum base as that of Example 1 except that no anodic oxide layer was used. The aluminum base was subjected to an injection molding to form a resin layer of 0.5 mm thickness. In this example, the resin layer was made of a PPS resin without any additional carbon material, such as a carbon black or a carbon fiber. Then, a resistance resin layer having the composition corresponding to that of the sample B in Table 1 was applied on the resin layer. The resistance resin layer thus formed was of 1.5 mm in thickness.

The obtained fixing roller was subjected to the same tests as that of Example 1. The results were that the fixing roller was heated up to 130 C.° in 10 to 13 seconds at a current of about 12 A. In addition, the fixing roller showed excellent fixing properties without causing any toner offset.

Consequently, the present invention provides a fixing roller having a resin layer and an injection-molded resistance resin layer on an outer surface of a cylindrical-shaped metallic base in that order. The laminate structure of the fixing roller cannot be peeled off into pieces and shows an excellent heat stability because the laminate structure is formed under pressure during the injection-molding so as to bring one layer into intimate contact with the other.

In the above configuration of the fixing roller according to the present invention, the specific volume resistance of the resistance resin layer in the axial direction is 2 Ωcm or less, so that the fixing of toner can be performed within 20 seconds after passing electric current through the electrodes. This may eliminate or lessen the need for a preheat current.

Furthermore, according to the present invention, the resistance resin layer comprises 10 to 50% by weight of the conductive additives (i.e., the mixture of carbon black and carbon fiber) with respect to the resin, and also a weight ratio expressed by dividing the weight of the carbon black by that of the carbon fiber is in the range of 0.25 to 4.5. Therefore the above specific volume resistance can be stabilized at an appropriate level entirely, so that the fixing roller performs the fixation uniformly.

The above resistance resin layer mainly comprises the resin selected from a polyphenylene sulfide resin, a polyphthalamide resin, and a liquid crystal polymer resin. Therefore, the resistance resin layer does not cause toner offset and does not deteriorate regardless of the fixing roller being held at fixing temperature for a long time.

The resistance resin layer is formed using the injection molding die to mold the resin having a side gate structure, so that the fixing roller with precise dimensions can be manufactured with an improved yield.

What is claimed is:

1. A fixing roller for an electrophotographic device, comprising:

a cylindrical-shaped metallic base body having an outer peripheral surface;

an insulation layer formed on the outer peripheral surface of said cylindrical-shaped metallic base body; and a resistance resin layer formed on said insulation layer.

2. A fixing roller as claimed in claim 1, wherein a specific volume resistance of said resistance resin layer in a direction along a central line of said cylindrical-shaped metallic base body is 2 Ωcm or less.

3. A fixing roller as claimed in claim 1, wherein said resistance resin layer comprises a resin selected from a group consisting of a polyphenylene sulfide resin, a polyphthalamide resin, and a liquid crystal polymer resin.

4. A fixing roller as claimed in claim 1, wherein said resistance resin layer comprises:

a resin selected from a group consisting of a polyphenylene sulfide resin, a polyphthalamide resin, and a liquid crystal polymer resin; and a mixture of carbon black and carbon fiber, wherein 10 to 50% by weight of said resistance resin layer comprises said mixture, and a weight ratio expressed as a weight of said carbon black divided by a weight of said carbon fiber is in a range of 0.25 to 4.5.

5. A fixing roller as claimed in claim 1, wherein said insulating layer comprises a resin, and said resistance resin layer comprises said resin.

6. A fixing roller as claimed in claim 1, wherein said cylindrical-shared metallic base body comprises a metal selected from a group consisting of an aluminum and an aluminum alloy.

7. A fixing roller as claimed in claim 1, wherein said insulating layer comprises an anodic oxide layer.

8. A fixing roller as claimed in claim 1, further comprising:

ring-shaped metallic electrodes concentrically formed on both ends of said resistance resin layer.

9. A fixing roller as claimed in claim 1, wherein said resistance resin layer is formed using an injection-molding technique.

10. A fixing roller as claimed in claim 1, wherein said resistance resin layer is formed using an injection-molding technique in which a die having a side gate structure is used as a resin-molding die.

11. A fixing roller as claimed in claim 1, further comprising:

a fluororesin-based coating formed on said resistance resin layer.

12. A method of forming a fixing roller for an electrophotographic device, comprising the steps of:

providing a cylindrical-shaped metallic base body having an outer peripheral surface;

forming an insulating layer on the outer peripheral surface of said cylindrical-shaped metallic base body; and forming a resistance resin layer on said insulating layer.

13. A method as claimed in claim 12, wherein a specific volume resistance of said resistance resin layer in a direction along a central line of said cylindrical-shaped metallic base body is 2 Ωcm or less.

14. A method as claimed in claim 12, wherein said resistance resin layer comprises a resin selected from the group consisting of a polyphenylene sulfide resin, a polyphthalamide resin, and a liquid crystal polymer resin.

15. A method as claimed in claim 12, wherein said resistance resin layer comprises:

a resin selected from a group consisting of a polyphenylene sulfide resin, a polyphthalamide resin, and a liquid crystal polymer resin; and a mixture of carbon black and carbon fiber, wherein 10 to 50% by weight of said resistance resin layer comprises said mixture, and a weight ratio expressed as a weight of said carbon black divided by a weight of said carbon fiber is in a range of 0.25 to 4.5.

16. A method as claimed in claim 12, wherein said insulating layer comprises a resin, and said resistance resin layer comprises said resin.

17. A method as claimed in claim 12, wherein said cylindrical-shaped metallic base body comprises a metal selected from a group consisting of an aluminum and an aluminum alloy.

18. A method as claimed in claim 12, wherein said insulating layer comprises an anodic oxide layer.

19. A method as claimed in claim 12, further comprising the step of:

forming ring-shaped metallic electrodes concentrically on both ends of said resistance resin layer.

20. A method as claimed in claim 12, wherein said resistance resin layer is formed using an injection-molding technique.

21. A method as claimed in claim 12, wherein said resistance resin layer is formed using an injection-molding technique in which a die having a side gate structure is used as a resin-molding die.

22. A method as claimed in claim 12, further comprising the step of:

forming a fluororesin-based coating on said resistance resin layer.

* * * * *